US008434695B2

(12) United States Patent
Barzuza

(10) Patent No.: US 8,434,695 B2
(45) Date of Patent: May 7, 2013

(54) ROTARY WATER SPRINKLER

(76) Inventor: Isaac Barzuza, Petach Tikva (IL)

( * ) Notice: Subject to any disclaimer, the term of this patent is extended or adjusted under 35 U.S.C. 154(b) by 846 days.

(21) Appl. No.: 12/438,755

(22) PCT Filed: Sep. 9, 2007

(86) PCT No.: PCT/IL2007/001105

§ 371 (c)(1),
(2), (4) Date: Feb. 25, 2009

(87) PCT Pub. No.: WO2008/029409

PCT Pub. Date: Mar. 13, 2008

(65) Prior Publication Data

US 2010/0012749 A1 Jan. 21, 2010

(30) Foreign Application Priority Data

Sep. 10, 2006 (IL) ..... 177981

(51) Int. Cl.

| | |
|---|---|
| ***B05B 3/02*** | (2006.01) |
| ***F23D 11/04*** | (2006.01) |
| *B05B 3/10* | (2006.01) |
| *B44D 5/10* | (2006.01) |

(52) U.S. Cl.
USPC ..... 239/222.17; 239/222.11; 239/222.13; 239/222.21; 239/214; 239/223

(58) Field of Classification Search ..... 239/230, 239/246, 233, 225.1, 222.11, 222.13, 289, 239/222.17
See application file for complete search history.

(56) References Cited

U.S. PATENT DOCUMENTS

| | | | | | |
|---|---|---|---|---|---|
| 599,330 | A | * | 2/1898 | Hale | 239/222.17 |
| 2,488,234 | A | * | 11/1949 | Perry | 239/222.17 |
| 3,036,782 | A | * | 5/1962 | Windsor | 239/452 |
| 3,347,463 | A | * | 10/1967 | Baker | 239/113 |
| 3,877,644 | A | | 4/1975 | Cockman | |
| 4,356,972 | A | * | 11/1982 | Vikre | 239/173 |
| 4,560,108 | A | * | 12/1985 | Rubinstein | 239/222.17 |
| 4,583,689 | A | * | 4/1986 | Rosenberg | 239/381 |
| 4,796,811 | A | * | 1/1989 | Davisson | 239/222.17 |
| 4,886,211 | A | * | 12/1989 | Cohen | 239/222.17 |

(Continued)

FOREIGN PATENT DOCUMENTS

EP 0 409 251 A2 1/1991

OTHER PUBLICATIONS

Notification of transmittal of International Search Report and Written Opinion for PCT Application No. PCT/IL2007/001105 dated Dec. 13, 2007.

*Primary Examiner* — Len Tran
*Assistant Examiner* — Viet Le
(74) *Attorney, Agent, or Firm* — Jenkins, Wilson, Taylor & Hunt, P.A.

(57) ABSTRACT

A rotary sprinkler including a body member (A) having a water inlet nozzle (4) with a top end and a bottom end, a pressurized water connector (8) communicating with the bottom end of the water inlet nozzle, a ring (14) attached in spaced-apart relationship from the top end of the nozzle, and a rotor member (B) having at one end an opening (30) for receiving water from the inlet nozzle and directing it to a water distributing groove, and at its opposite end, an axle (36). The rotary sprinkler also includes a rotor axle seat member (c) engageable and disengageable with the rotor's axle and with the ring facilitating, upon disengagement of the seat member from the ring, axial retrieval of the rotor member through the ring.

23 Claims, 3 Drawing Sheets

U.S. PATENT DOCUMENTS 5,007,586 A * 4/1991 Cohen ..... 239/222.17
5,224,653 A * 7/1993 Nelson et al. ..... 239/222.17
5,439,174 A * 8/1995 Sweet ..... 239/222.17
6,135,364 A * 10/2000 Nickish ..... 239/222.17
7,070,122 B2 * 7/2006 Burcham et al. ..... 239/231
7,395,977 B2 * 7/2008 Pinch et al. ..... 239/222.21

* cited by examiner

ROTARY WATER SPRINKLER

FIELD OF THE INVENTION

The present invention relates to rotary water sprinklers such as those used for irrigating crops. More particularly, the invention is concerned with a rotary water sprinkler, which includes an insect protection cup to protect the sprinkler from entry of insects, or other objects, during non-operating periods of the sprinkler.

BACKGROUND OF THE INVENTION

There exist water irrigation sprinklers consisting of a body member that support a nozzle and an insect protection cup. Existing mini-sprinklers further contain a rotor that directs the water flow and rotates during operation and a bearing that supports the rotor during its rotation. In the known sprinklers, either the nozzle or the insect protection cup are separate parts tightly connectable to the body member. One of the drawbacks of this configuration is that the alignment of the assembled parts is not accurate and, as a result, the rotor may get stuck or cause extensive wear of the bearing.

As known by persons skilled in the art, the bearing must be located ahead of the nozzle to support the axial rotation of the rotor. In existing sprinklers and mini-sprinklers, the bearing can be an integral part of the body member. In some cases, the body member contains a bearing seat above the rotor. In the existing sprinklers, however, the body member blocks the space above the rotor in a way that prevents, even when the bearing holder is removed, axial assembling and disassembling of the rotor, for cleansing purposes.

SUMMARY OF THE INVENTION

It is therefore one of the objects of the present invention to provide a rotary sprinkler in which, once the bearing holder is removed and the space ahead of the nozzle is free, an axial assembly and disassembly of the rotor along the nozzle axis, is possible.

It is a further object of the present invention to provide a rotary sprinkler which includes a body member, a rotor member having a protection cup and a bearing seat made of three parts.

In accordance with the present invention there is therefore provided a rotary sprinkler, comprising a body member including a water inlet nozzle having a top end and a bottom end, a pressurized water connector communicating with the bottom end of said water inlet nozzle, and a ring attached in spaced-apart relationship from the top end of the nozzle, a rotor member having at one end an opening for receiving water from said inlet nozzle and directing it to a water distributing groove, and at its opposite end, an axle, and a rotor axle seat member engageable and disengageable with said rotor's axle and with said ring facilitating, upon disengagement of said seat member from the ring, axial retrieval of the rotor member through said ring.

The invention further provides a rotary sprinkler, comprising a body member including a cup open at its top housing a rotor member, said cup including a water inlet nozzle having a top end and a bottom end, projecting into said cup and a pressurized water connector communicating with the bottom end of said water inlet nozzle, and a ring attached to said body member in spaced-apart relationship from the top end of said nozzle, a rotor member having at one end an opening for receiving water from said water inlet nozzle and directing it to a water-distributing groove and at its opposite end, an axle, and a rotor axle seat member engageable and disengageable with the rotor's axle and with said ring.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 1A and 1B illustrate two isometric views of the body member including a nozzle of the sprinkler, according to the present invention;

FIG. 2 is a side elevational view showing the body member of FIG. 1 with several sections removed for clarity, also showing the sprinkler's rotor;

FIG. 3 is an isometrical view, to an enlarged scale, of rotor axle seat member C;

FIG. 4 is a side elevational view, partly in section, illustrating the rotary sprinkler constructed in accordance with the present invention, in its non-operative state, and FIG. 5 is a view similar to that of FIG. 4, but showing the sprinkler in its operative state.

DETAILED DESCRIPTION

Figure 1A:
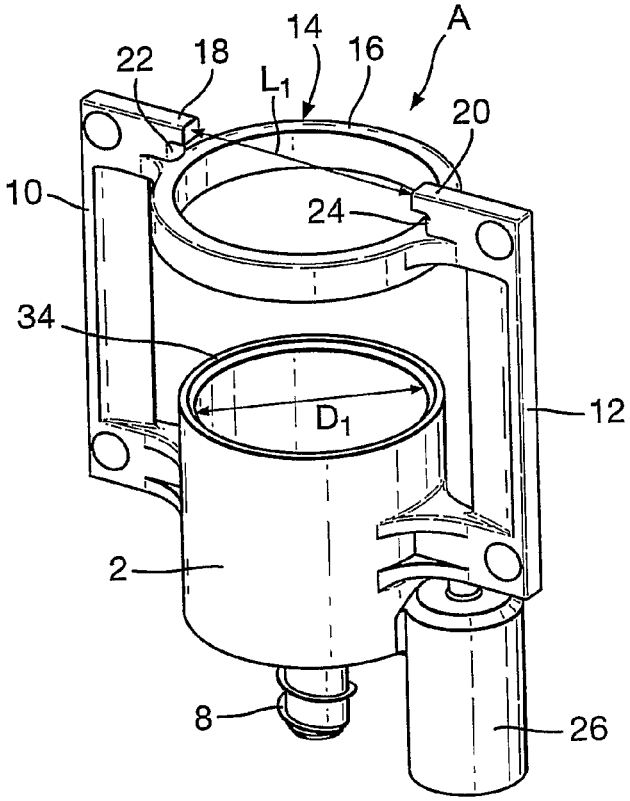
Figure 1B:
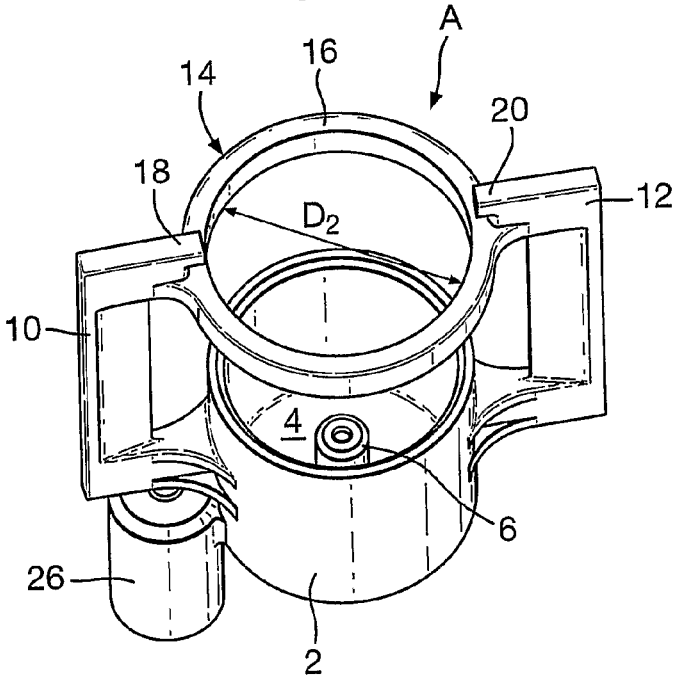
Figure 2:
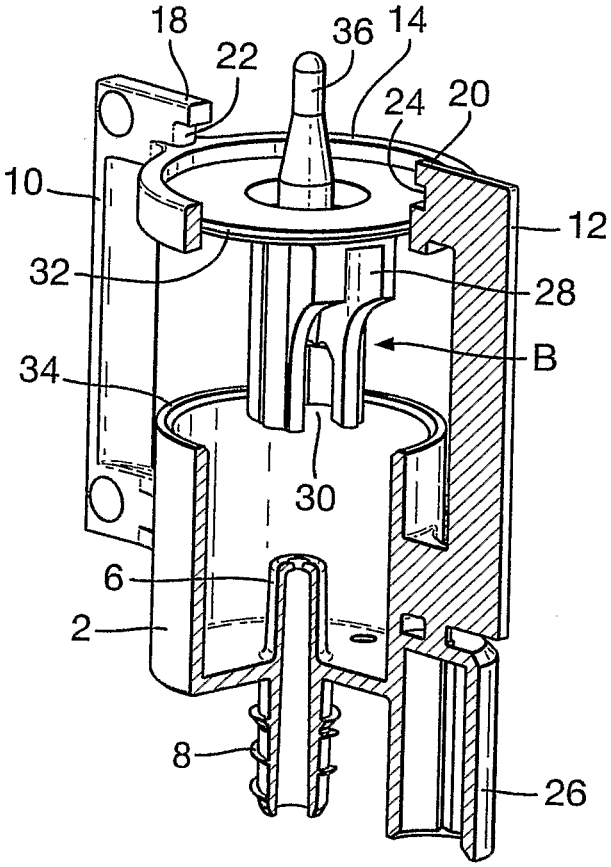
Figure 3:
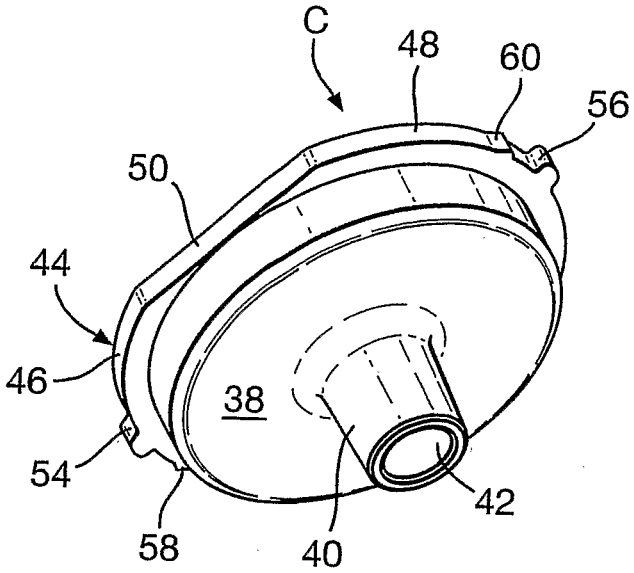

The rotary sprinkler according to the present invention is made and assembled of three parts: a body member A (FIGS. 1A and 1B); a rotor member B (FIG. 2) and a rotor axle seat member C (FIG. 3).

The body member A is composed of a cup 2 having a cavity and being open at its upper part. The cavity defines an opening having a diameter $D_1$. At its bottom surface 4 (FIG. 1B) cup 2 is fitted with a water inlet nozzle 6 projecting into the cup and communicating with an externally-threaded connector 8 to which a conduit leading from a pressurized water source is connectable. To the cup 2 there are attached two oppositely disposed, upwardly extending arms 10, 12 affixed to a ring 14 having an upper surface 16 and a lower surface and defining an opening of a diameter $D_2$, wherein $D_2$ is equal to, or slightly larger than $D_1$. Between the upper surface 16 of the ring 14 and the projecting edges 18, 20 of the arms 10, 12, spaced-apart at a distance $L_1$, there are formed recesses 22, 24, the functions of which will be described hereinafter. The body member A may optionally be formed with an inverted socket 26, to which a stem (not shown) may be attached for sticking the sprinkler into the ground.

A rotor member B (FIG. 2) is formed with at least one water distributing groove 28 extending from an opening 30 of a size sufficiently large to accommodate at least the upper end of inlet nozzle 6, when the rotor rests on the bottom surface 4 of the cup 2. Optionally, above the groove 28, the rotor member B has an integrally made disc-shaped cover 32 of a diameter slightly smaller than $D_2$, but larger than the diameter of $D_1$ of the cup 2, so as to rest, when not in action, on the rim 34 of the cup 2. The rotor member B is further fitted with an axle 36 in the form of a pin, projecting from the upper surface of the cover 32.

The third member C is illustrated in FIG. 3 and comprises a disc-shaped member having at its bottom surface 38, a seat 40 configured as a socket with a bore 42. At its upper peripheral edge, there is formed a flange 44, having two diametrically oppositely disposed arcuate sections 46, 48, separated by two diametrically oppositely disposed straight sections 50, 52 (52 not seen in FIG. 3). The distance between the two oppositely disposed flat sections 50, 52, is equal to, or slightly smaller than, the distance L1 between the edges 18, 20. This enables the member C to be inserted in the ring 14, so that the flange 44 rests on the upper surface of the ring 14, while the tip of the axle 36 is disposed in the bore 42. At this position, the member C can be rotated 90°, thereby sliding the arcuate sections 46, 48 in recesses 22, 24, respectively. In order to avoid dislodgement of the member C from the ring 14, and to lock it in place, the arcuate sections 46, 48 are formed with stop projections 54, 56, respectively, spaced apart from detents 58, 60. The distance between each of the detents and an adjacent stop projection, substantially equals the thickness of the arms 10, 12. The upper surface of the member C is advantageously provided with a rib or the like (not shown), facilitating gripping of the seat member C with two fingers and its rotation for locking and unlocking.

Figure 4:
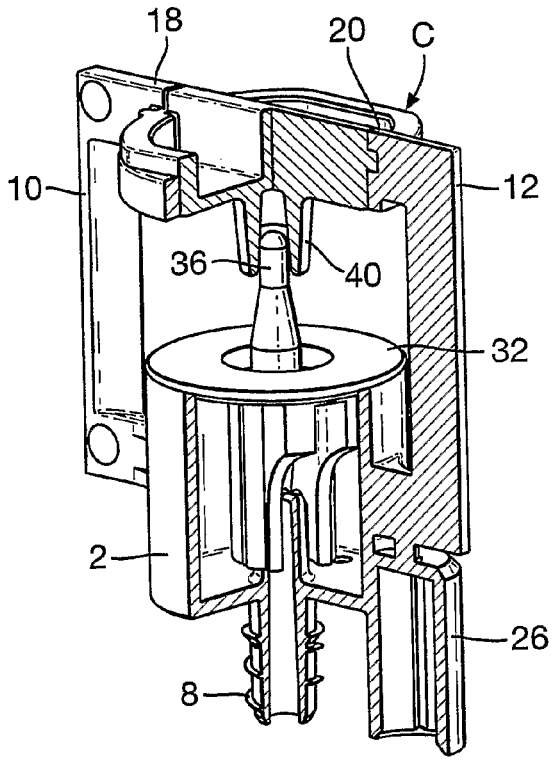
Figure 5:
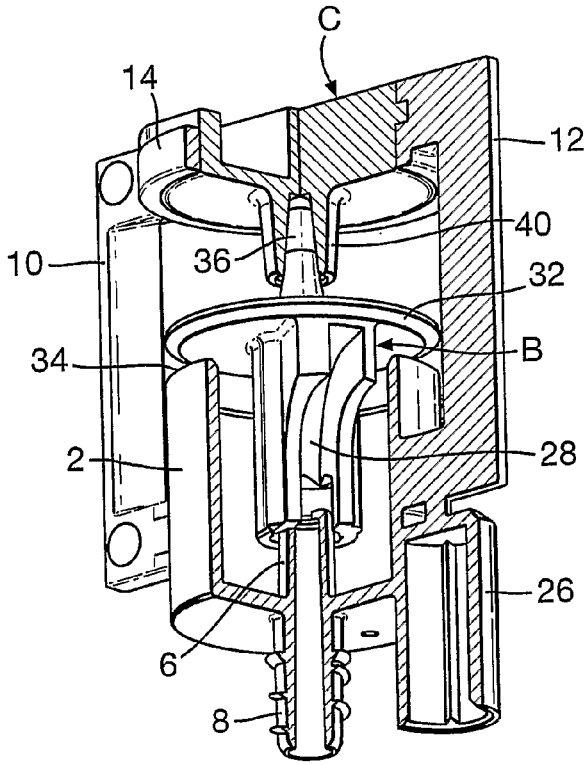

Turning now to FIGS. 4 and 5, the water sprinkler illustrated in the figures operates as follows:

As seen in FIG. 4, the sprinkler is in its non-operative state, i.e., not receiving pressurized water. In this state of the sprinkler, gravity (and optionally a spring) urges the rotor member B away from the member C and towards nozzle 6, such that the cover 32 closes the open end of the cup 2. At this non-operative state of the sprinkler, cover 32 of the rotor blocks the entry of ants or other matter, which may tend to clog the nozzle 6.

When pressurized water is applied to nozzle 6 via its connector 8, the nozzle produces a water jet, which impinges on the lower surface of the cover 32 of the rotor, and is directed by groove 28 radially, towards the outside. The water jet passing through groove 28 also rotates the rotor, so that the water jet exiting in the groove discharges the water angularly or laterally around the sprinkler.

When the sprinkler has to be cleaned or fixed, the rotor is disassembled by first rotating the member C, say, a quarter of a circle, for effecting its dislodgement from the detent 58, 60, and its extraction from the ring 16 (FIG. 2). The rotor member B can subsequently be axially retrieved by pulling it upwards from within the cup 2 and through the ring 16, and reassembled in a reverse manner.

The ring 16 may not necessarily be exactly cylindrical and member C may be attached to the ring in a variety of manners, not necessarily by rotation. Accordingly, the ring 16, while preferably being circular as shown, which is symmetric with regard to all directions, could also be partly symmetrical, namely symmetric in some directions only, e.g., oval, or could even be a polygon or a regular polygon.

The body member is usually manufactured from plastic material by injection molding, utilizing two or more recessed plates and a number of shafts that form the cavities of the body member. The shafts are pushed in between the tightened plates during the injection of the plastic material and withdrawn once the plastic solidifies, by first spacing apart the plates. As long as the opening of the ring, or any other similarly configured member defining an opening, is larger than the opening of the cup, a single shaft can form the cavity of the cup and the opening of the ring, and the shaft is free to be axially withdrawn from the product after the solidification of the plastic. On the other hand, if the opening of the ring is smaller than the cavity of the cup, a shaft that forms the opening of the ring cannot be axially withdrawn through the ring, without breaking it. Therefore, the above-described preferred embodiments facilitate efficient production of the body member using a single shaft, axially retrievable, providing a superior solution.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotary sprinkler, comprising:

a body member including a water inlet nozzle having a top end and a bottom end, a pressurized water connector communicating with the bottom end of said water inlet nozzle, and a ring attached to the body member in spaced-apart relationship from the top end of the nozzle, the body member further comprising a cup having a bottom end fluidly coupled to the water inlet nozzle, and being open at its top end but otherwise being substantially closed and housing said rotor member in non-operative states of the sprinkler, a rotor member having at a first end an opening configured for receiving water from said inlet nozzle and for directing it to a water distributing groove, and said rotor member having an axle at a second end opposite the first end and protruding through an annular cover that is integral with the rotor member and is supported at the second end thereof so as to cover the top end of the cup in non-operative states of the sprinkler with the rotor member housed inside the cup and thereby prevent entry of insects or other matter that might otherwise tend to clog the nozzle, and a rotor axle seat member engageable and disengageable with the axle of said rotor member and with said ring, said ring being of larger diameter than the rotor member so as to allow axial removal of the rotor member through the ring upon disengagement of said rotor axle seat member from the ring.

2. The sprinkler as claimed in claim 1, wherein said rotor member has an integral cover interposed between the groove and said axle.

3. The sprinkler as claimed in claim 2, wherein said body member further comprises a cup, open at its top end and housing said rotor member in non-operative states of the sprinkler.

4. The sprinkler as claimed in claim 3, wherein said cover is disc-shaped having a diameter sized to rest on the top of said cup.

5. The sprinkler as claimed in claim 4, wherein said ring has an inner and an outer diameter, said inner diameter being substantially equal to, or slightly larger than, the diameter of said cover.

6. The sprinkler as claimed in claim 3, wherein each of said ring and said cup have an inner and an outer diameter, the inner diameter of said cup being slightly smaller than the inner diameter of said ring.

7. The sprinkler as claimed in claim 3, wherein said ring is attached to the cup by two diametrically-disposed arms.

8. The sprinkler as claimed in claim 7, wherein said ring has a top surface and each of the arms has a projection forming a recess with the top surface of said ring.

9. The sprinkler as claimed in claim 8, wherein said rotor axle seat member has an annular flange having two diametrically opposed arcuate sections and two diametrically opposed straight sections.

10. The sprinkler as claimed in claim 9, wherein a distance between the two straight sections substantially equals a distance between said projections.

11. The sprinkler as claimed in claim 9, wherein on at least one of said oppositely disposed arcuate sections, there is a stop projection restricting rotation of said rotor axle seat member.

12. The sprinkler as claimed in claim 11, wherein in respect of each of said stop projections, there is formed on the respective arcuate section a detent spaced-apart from said stop projection.

13. A rotary sprinkler, comprising:

a body member including a cup open at its top and housing a rotor member, said cup including a water inlet nozzle having a top end and a bottom end, the bottom end projecting into said cup and the body member further including a pressurized water connector communicating with the bottom end of said water inlet nozzle, and a ring attached to said body member in spaced-apart relationship from the top end of said nozzle, the cup having a bottom end fluidly coupled to the water inlet nozzle, and being open at its top end but otherwise being substantially closed and housing said rotor member in non-operative states of the sprinkler, said rotor member having at a first end an opening configured for receiving water from said water inlet nozzle and for directing it to a water-distributing groove and said rotor member having an axle at a second end opposite the first end and protruding through an annular cover that is integral with the rotor member and is supported at the second end thereof so as to cover the to end of the cu in non-operative states of the sprinkler with the rotor member housed inside the cup and thereby prevent entry of insects or other matter that might otherwise tend to clog the nozzle, and a rotor axle seat member engageable and disengageable with the axle of said rotor member;

said ring being of larger diameter than the rotor member so as to allow axial removal of the rotor member through the ring.

14. A rotary sprinkler as claimed in claim 13, wherein said cup has a cavity defining an opening and said ring delimiting an opening, and wherein the opening of the ring is no smaller than the opening of the cup, allowing a single shaft to axially penetrate through the ring and fill the cavity of the cup and opening of the ring.

15. A rotary sprinkler, comprising:

a body member including:

a water inlet nozzle having a top end and a bottom end, a cup having a bottom end fluidly coupled to the water inlet nozzle, and being open at its top end but otherwise being substantially closed and housing a rotor member in non-operative states of the sprinkler, a pressurized water connector communicating with the bottom end of said water inlet nozzle, and a ring attached to the cup by two diametrically-disposed arms in spaced-apart relationship from the top end of the nozzle, said ring having a top surface and each of the arms having a projection forming a recess with the top surface of said ring;

a rotor member having at a first end an opening configured for receiving water from said inlet nozzle and for directing it to a water distributing groove, and said rotor member having an axle at a second end and opposite the first end and protruding through an integral cover that is interposed between the groove and said axle and is supported at the second end thereof so as to cover the top end of the cup in non-operative states of the sprinkler with the rotor member housed inside the cup and thereby prevent entry of insects or other matter that might otherwise tend to clog the nozzle, and a rotor axle seat member engageable and disengageable with the axle of said rotor member and with said ring, said ring being dimensioned for axial retrieval of the rotor member through the ring upon disengagement of said rotor axle seat member from the ring.

16. The sprinkler as claimed in claim 15, wherein said rotor axle seat member has an annular flange having two diametrically opposed arcuate sections and two diametrically opposed straight sections.

17. The sprinkler as claimed in claim 16, wherein a distance between the two straight sections substantially equals a distance between said projections.

18. The sprinkler as claimed in claim 16, wherein on at least one of said oppositely disposed arcuate sections, there is a stop projection restricting rotation of said rotor axle seat member.

19. The sprinkler as claimed in claim 18, wherein in respect of each of said stop projections, there is formed on the respective arcuate section a detent spaced-apart from said stop projection.

20. The sprinkler as claimed in claim 1, wherein the ring and the body member are a unitary structure.

21. The sprinkler as claimed in claim 1, wherein the ring is located above the distributing groove so that water that is redirected by the distributing groove does not reach the ring.

22. The sprinkler as claimed in claim 13, wherein the ring and the body member are a unitary structure.

23. The sprinkler as claimed in claim 13, wherein the ring is located above the distributing groove so that water that is redirected by the distributing groove does not reach the ring.

* * * * *